United States Patent [19]

Tedioli

[11] Patent Number: 4,760,243

[45] Date of Patent: Jul. 26, 1988

[54] APPARATUS FOR LETTING OUT HOT AIR, USED AS HEATER AND DRIER PARTICULARLY IN BATHROOMS

[75] Inventor: Pier G. Tedioli, Todi, Italy

[73] Assignee: Eugenio Bertagnoli, Cologno Monzese, Italy; a part interest

[21] Appl. No.: 88,256

[22] Filed: Aug. 24, 1987

[30] Foreign Application Priority Data

Sep. 2, 1986 [IT] Italy ..... 22861/86[U]

[51] Int. Cl.[4] ..... H05B 1/00

[52] U.S. Cl. ..... 219/366; 34/239; 219/342; 219/347; 219/369; 219/370; 248/276

[58] Field of Search ..... 219/366, 342, 369, 370, 219/347; 34/243 R, 151, 97, 96, 239; 248/264, 276, 201, 202.1

[56] References Cited

U.S. PATENT DOCUMENTS 2,815,585 12/1957 Thompson ..... 34/151
2,919,497 1/1960 Konstandt ..... 34/151
4,625,432 12/1986 Baltes ..... 34/151
4,642,909 2/1987 Garcia ..... 34/97

*Primary Examiner*—C. L. Albritton
*Attorney, Agent, or Firm*—Young & Thompson

[57] ABSTRACT

An electric heating and drying apparatus, of the type comprising, housed in a box-type body having at least partially open walls, a heating resistance and a fan arranged to blow air through said resistance towards an outlet opening, said box-type body being mounted on a support base on which it is adjustably positioned, said base comprising floor resting means and wall connection means. According to the invention stop means are provided, operating between the box-type body and the base, which stop means, when the base is resting on the floor, assume one position determining rigid fixing of the body to the base without the relative position of these latter being able to undergo adjustment, and which, when the base is connected to the wall, assume at least one position which allows the body to be freely adjusted relative to the base.

10 Claims, 5 Drawing Sheets

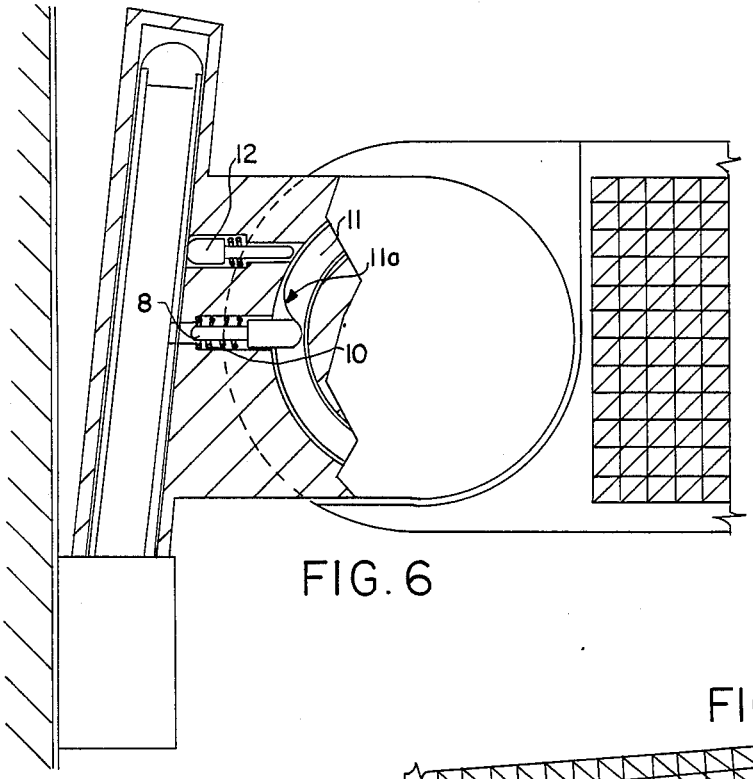
FIG. 6
FIG. 7
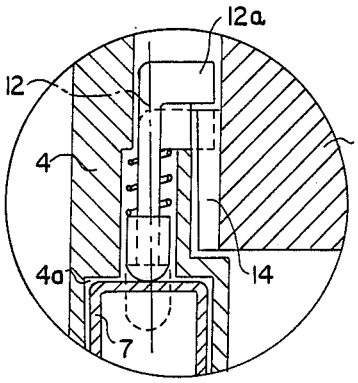
FIG. 8
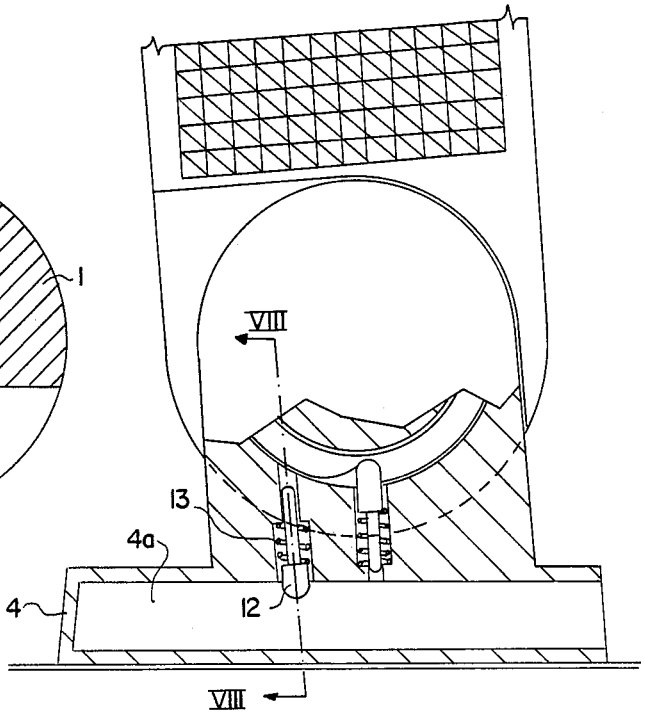

APPARATUS FOR LETTING OUT HOT AIR, USED AS HEATER AND DRIER PARTICULARLY IN BATHROOMS

BACKGROUND OF THE INVENTION

1. Field of the Invention

Various types of electrical apparatuses particularly for bathroom use are available which deliver a stream of hot air for heating the room. These apparatuses are basically heaters, they consisting essentially of an electrical resistance through which a current flows of sufficient strength to raise it to high temperature, and a fan which blows air through the resistance and to a downstream outlet mouth leading to the surrounding enviroment.

In addition to these apparatuses, which are of very simple structure and are available in a large number of types, wall-mountable electric apparatuses have been more recently placed on the market which are able to deliver a hot air stream in a downward direction, towards a clothes rack which is also mounted on the wall immediately below the apparatus. These apparatuses are basically driers, their purpose being essentially to dry the hanging clothes.

It should be noted that the aforesaid apparatuses of heater type, which are constructed for simply resting on the ground, are not suitable for use as driers in that their design results in a hot air stream being delivered in an essentially horizontal direction, such a stream being obviously unsuitable for drying clothes hung vertically. On the other hand, apparatuses of drier type are not suitable as heaters, because as their air stream is directed vertically in proximity to a bathroom wall, it provides no enviromental confort.

2. Description of the Prior Art

A device apt to carry out both the heater and drier functions is already disclosed in the FR-A-No. 2136153. This device however does not answer to the present safety regulations which impose:

from one hand, that in case of falling of drops of water, these drops cannot enter inside the apparatus as far as the electric resistances.

from the other hand, that its resting on the ground is guaranteed steady in every working position.

In fact in the FR-A-No. 2136153 some water drops which fall downwards can enter in the apparatus in every working position (due to the great air inlet opening) and in particular in the position of FIG. 5, in which the water drops can enter also in the air outlet opening. Besides it does not result from the FR-A-No. 2136153, in which way the stability is assured in an intermediate position between the positions of FIGS. 4 and 5.

SUMMARY OF THE INVENTION

The object of the present invention is to provide an apparatus of the type comprising an in-air electrical resistance and a fan, which is able to perform different functions and in particular both the known heater and drier functions assuring however the observance of the safety regulations.

This result is attained in a apparatus comprising an essentially flat box-type body incorporating the heating resistance and fan, and a support base on which the box-type body is adjustably positioned, said base comprising floor resting means and wall connection means, stop means being also provided, operating between the box-type body and the base, which stop means, when the base is resting on the floor, assume one position determining rigid fixing of the body to the base without the relative position of these latter being able to undergo adjustment, and which, when the base is connected to the wall, assume at least one position which allows the body to be freely adjusted relative to the base.

According to a further important characteristic of the invention, the air inlet opening of the apparatus is formed on at least one if its sides, which is positioned in a vertical plane in every working position of the apparatus itself.

BRIEF DESCRIPTION OF THE DRAWINGS

Further characteristics and advantages of the present invention will be more apparent from the description given hereinafter of a preferred embodiment thereof illustrated by way of example on the accompanying drawings, in which:

FIG. 6 is a view similar to that of FIG. 4, but with the apparatus rotated into a position corresponding to that of FIG. 3;

FIG. 7 is a view similar to that of FIG. 4, but with the apparatus in its floor-resting position shown in FIG. 1; and FIG. 8 is a detailed view of a stop device to an enlarged scale, shown in section on the line VIII—VIII of FIG. 7.

DESCRIPTION OF THE PREFERRED EMBODIMENTS

As shown on the drawings, the electrical apparatus according to the invention consists of a box-type body essentially in the form of a flat rectangular parallelepiped with its two major narrow sides rounded in the form of a half cylinder. In correspondence with the two minor narrow sides there are provided grilles 2 for the intake of room air, and along a centre line of the major sides there is provided a grille 3 with parallel fins for hot air outlet.

The box-type body 1 is mounted on a support base 4, consisting essentially of a pair of plate-structured feet which are rigidly connected together by a shaft 4'. The body 1 is rotatably mounted on the shaft 4' and its position relative to the base 4 is continuously adjustable, for example by a friction system interposed between the body 1 and the base 4. This adjustment is however limited, as described hereinafter.

The rigid connection of the two feet of the base 4 through the shaft 4' is not strictly necessary because—as it is evident hereinafter—the body 1 has the possibility to rotate in respect to the base 4 only when it is fixed to the wall and that is when the rigid connection is already assured by the anchoring of the feet to the support brackets fixed to the wall, as shown hereinafter.

Figure 1:
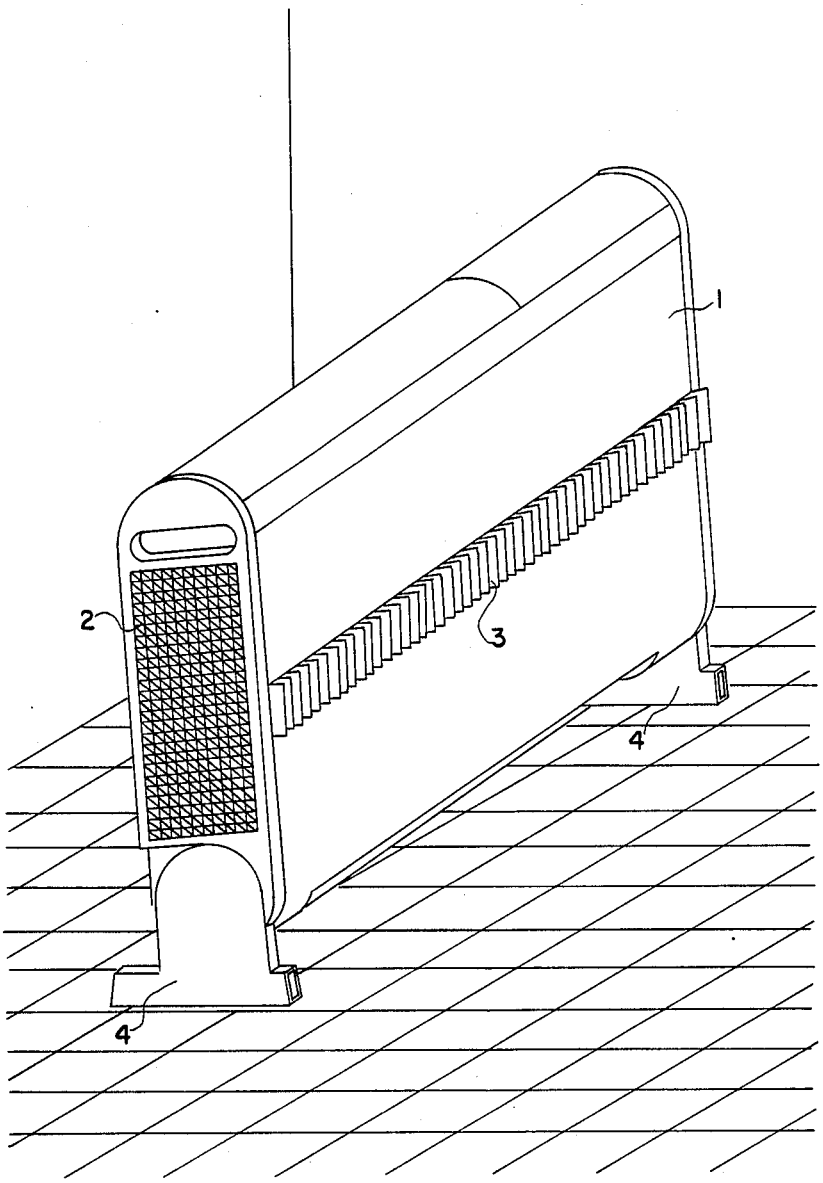
FIG. 1 is a diagrammatic perspective view of the apparatus according to the invention when resting on the ground.

The position shown in FIG. 1 is its floor resting position, for example resting on a bathroom floor P. In this position, the body 1 extends vertically upwards from the base 4, or rather is slightly inclined to the vertical, and acts essentially as a heater. In this position, the hot air stream which leaves the grille 3 perpendicular to the almost vertical plane of the major face of the body 1 creates a hot air circulation at low height through the bathroom which is particularly comfortable for room heating.

Figure 2:
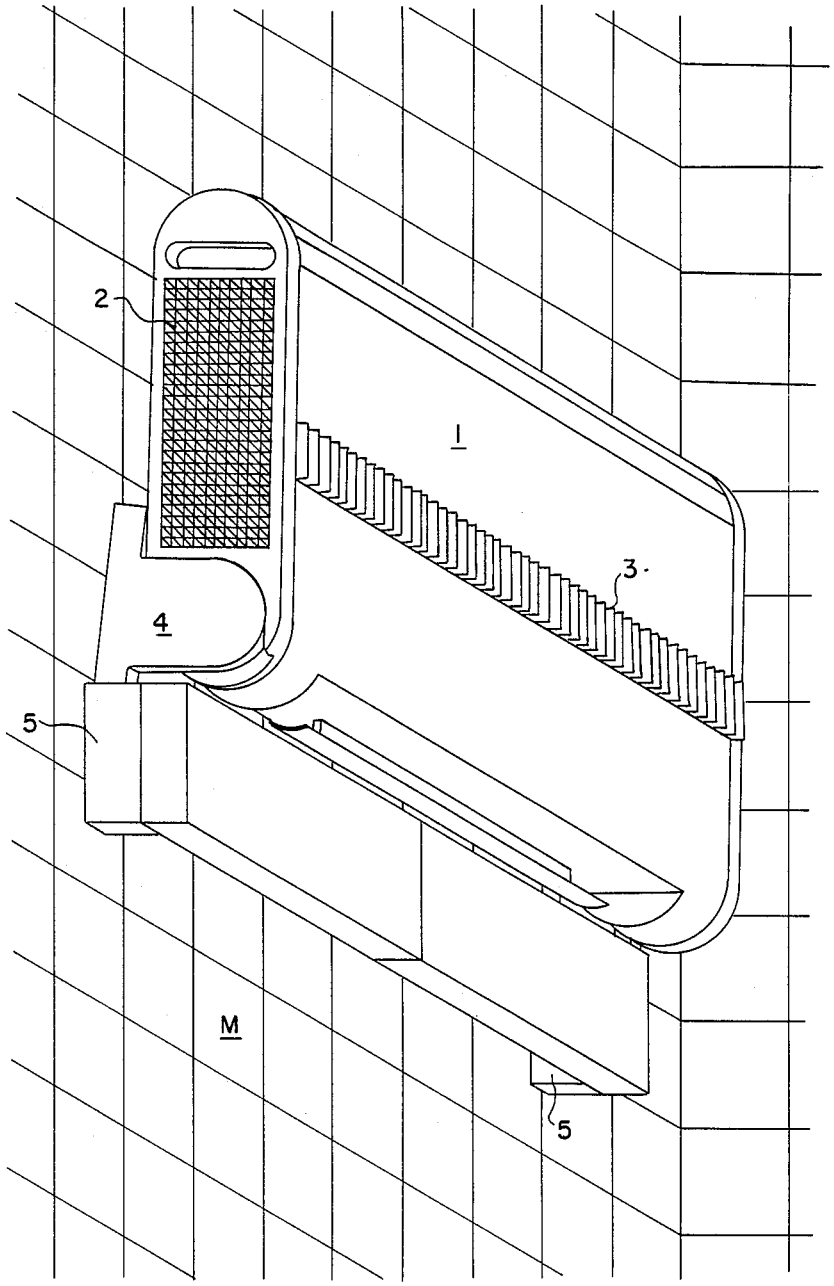
FIGS. 2 and 3 are perspective views of the same apparatus when fixed to the wall and shown in two limiting working positions, namely completely raised and lowered respectively.

The position shown in FIG. 2 is the wall-mounted position, with the apparatus at rest. In this figure it can be seen that the two feet of the base 4 are anchored to brackets 5 fixed to a bathroom wall M. Starting from this rest position, the body 1 can be rotated downwards about the base 4 to reach the position shown in FIG. 3. The body 1 can be halted and operated in any intermediate position between the two positions shown in FIGS. 2 and 3.

The apparatus can be operated in all these positions, and including that of FIG. 2 in which the body 1 is positioned vertically, almost adjacent to the wall M, as the air inlets 2 are provided on the sides and the hot air outlet is at the front grille 3. These different adjustable positions enable the hot air stream to be orientated in the best direction according to the requirements of the user.

In particular, it should be noted that when in its wall-mounted position, the apparatus according to the invention can be used as a hair drier, much more effectively than a normal domestic hair drier as it leaves both hands free. It is clear that because of the adjustability of the body 1 relative to the base 4, any person can find a hair drying position suitable for his height.

Figure 3:
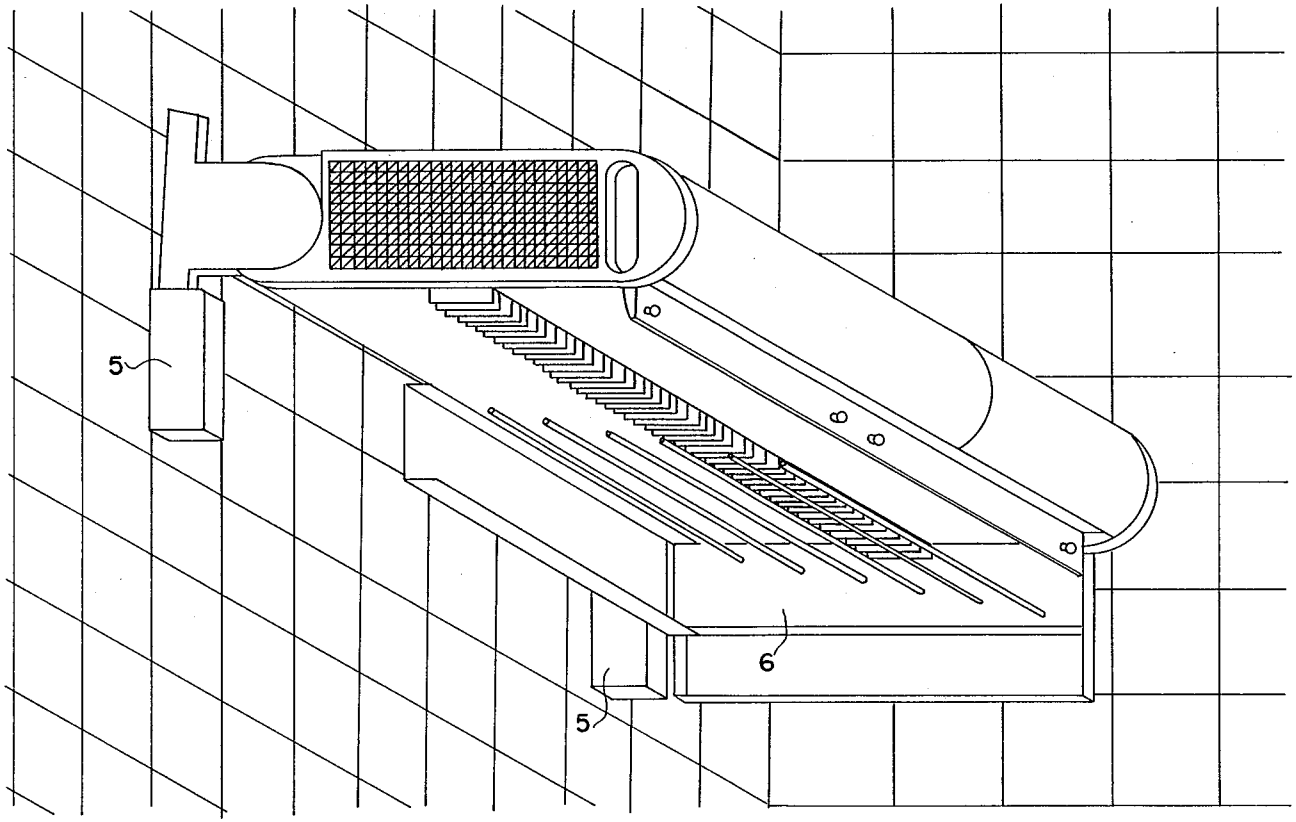

The position shown in FIG. 3 indicates that the apparatus according to the invention can be used as a clothes drier (in a similar manner to the clothes driers of the initially described type). In this respect, when the body 1 is horizontal (FIG. 3), it is able to feed a hot air stream downwards, i.e. towards a clothes rack 6 fixed to the wall below or in association with the brackets 5. Further description of the clothes rack 6 is not considered necessary as this is of known type and does not form part of the present invention.

To allow proper use of the apparatus, according to the safety regulations, and then in particular to prevent the risk of short circuiting or electrical discharges—this risk being always present in electrical appliances used in bathroom—the present invention provides stop and/or locking means which limit the usable positions. These means are described ind etail hereinafter with reference to FIGS. 4 to 8.

Figure 4:
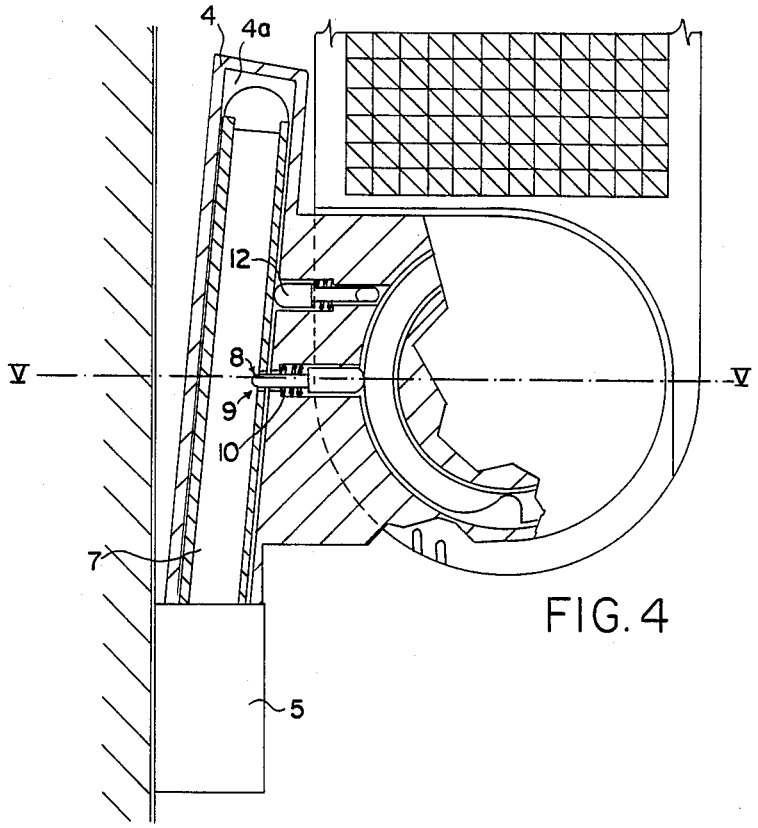
FIG. 4 is a partly cross-sectional end view of the apparatus when arranged in the position of FIG. 2.
Figure 5:
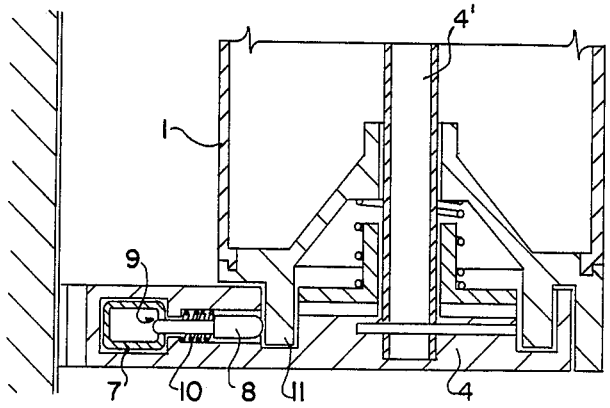
FIG. 5 is a diagrammatic section on the line V—V of FIG. 4.

As shown in FIG. 4, a tube or bar 7 projects upwards from the wall connection brackets 5 in a slightly oblique outward direction from the wall N. On the tube 7 is mounted the correspondingly shaped hollow seat 4*a* provided in the base 4 and complementary in shape to the tube 7, when in the position of FIG. 4, coresponding to that of FIG. 2, a spring-loaded pin 8 engages by insertion into the hole 9 provided in the wall of the tube 7 (see also FIG. 5).

The purpose of this insertion engagement is to prevent withdrawal of the base 4 from the bracket 5 when the body 1 is in the position shown in FIG. 2, or any intermediate position between the positions of FIGS. 1 and 2. In fact if the body 1 would be withdrawn from the brackets 5 in a similar position and rested on the floor, it would allow any water droplets fall downwards through the grille 3 and onto the heating resistance, against every safety regulation.

To withdraw the apparatus from the brackets 5, the body 1 must be rotated into the horizontal position shown in FIGS. 3 and 6. When in this position, the spring-loaded pin 8 is urged by its spring 10 into the cavity of a cam contour 11*a* provided on a ring 11 integral with the body 1 (see also FIG. 5) and becomes released form the hole 9.

When the apparatus has been withdrawn from the brackets 5, it can rest on the floor as shown in FIGS. 1 and 7. This latter figure shows that when the base 4 has been withdrawn from the tube 7 of the brackets 5, a second spring-loaded pin 12 can emerge towards the cavity 4*a* under the thrust of the respective spring 13.

As shown in FIG. 8, the pin 12 comprises a transverse tooth 12*a* arranged to cooperate in the following manner with the tooth 14 provided in the side of the body 1. When the base 4 is mounted on the respective bracket 5 and the tube 7 is housed within the cavity 4*a*, the pin 12 rests against the wall of the tube 7 (as also shown in FIGS. 4 and 6), and its tooth 12*a* is not engaged by the tooth 14. The body 1 is then free to rotate relative to the base 4, this being the case when the apparatus is wall-mounted on the brackets 5. In contrast, when the apparatus is withdrawn from the brackets 5, the pin 12 no longer rests against the tube 7 and is urged by the respective spring 13 into the cavity 4*a* (position indicated by dashed lines in FIG. 8), its tooth 12*a* engaging with the tooth 14 to prevent any rotation of the body 1 relative to the base 4. This second safety expedient prevents the body 1 being moved into a horizontal position or generally into a position inclined to the vertical safety position shown in FIG. 1 when its base 4 rests on the floor.

In the drawings, the stop pins 9, 12 are provided in correspondence with only one of the feet of the base 4, as these two feet are rigidly connected together by the shaft 4'. However it is also possible to renounce to this connection to the shaft 4' and to realize two separate feet: in this case however it will be necessary to provide the pins 9, 12 on both feet.

In conclusion it is to be noted that the safety regulations are completely respected; in fact:

(a) the stability of the apparatus is completely assured—in the floor resting position (FIGS. 1 and 7)—as it is impossible any rotation of the body 1 in respect to the base 4. Besides in this position the hot air outlet opening 3 is positioned according to a substantially vertical plane, so that possible water drops falling downwards cannot enter in the apparatus itself.

(b) besides, when the apparatus is fixed on the wall and then it can have ever oblique position, the opening 3 assumes always a position included between the vertical one and the one completely turned downwards (FIG. 3). Therefore it is even less possible that water drops can enter into the opening 3.

(c) from the other hand in every position of use, the air inlet opening 2, being formed at the sides of the apparatus, is always vertically positioned and then neither from this part the water drops can enter.

(d) at last it is also to be noted that when the apparatus is fixed on the wall and obliquely positioned, it cannot be taken out so that it is also excluded that it can be put on the floor in such an oblique position.

What is claimed is:

1. An electric heating and drying apparatus, of the type comprising, housed in a box-type body having at least partially open walls, a heating resistance and a fan arranged to blow air through said resistance towards an outlet opening, said box-type body being mounted on a support base on which it is adjustably positioned, said base comprising floor resting means and wall connection means, characterized in that stop means are provided, operating between the box-type body and the base, which stop means, when the base is resting on the floor, assume one position determining rigid fixing of the body to the base without the relative position of these latter being able to undergo adjustment, and which, when the base is connected to the wall, assume at least one position which allows the body to be freely adjusted relative to the base.

2. An apparatus as claimed in claim 1, wherein said box-type body (1) is formed as a flat rectangular parallelepiped and comprises air intake holes (2) in correspondence with the minor narrow sides which are always positioned in a vertical plane.

3. An apparatus as claimed in claim 1, wherein said box-type body (1) comprises at least one hot air outlet slit (31) in correspondence with one of the major sides.

4. Apparatus as claimed in claim 1 wherein said base consists of a pair of feet in the form of plates, which are mounted in correspondence to the two opposed sides of said box-type body and are rotatable about a common horizontal axis.

5. An apparatus as claimed in claim 1, wherein said base consists of feet in the form of plates which are rigidly connected together by a shaft (4') on which the body is pivotally mounted.

6. An apparatus as claimed in claim 1, wherein said support base comprises a seat arranged to cooperate with a wall connection bracket.

7. An apparatus as claimed in claim 6, wherein said connection bracket comprises an upwardly but obliquely projecting tube or bar element, on which said seat of the support base is mounted.

8. An apparatus as claimed in claim 7, wherein said stop means comprise at least one first spring-loaded pin slidable in a seat provided in said support base and engageable in a stop hole provided in said tube or bar element of the connecton bracket.

9. An apparatus as claimed in claim 8, wherein said box-type body has a cam contour arranged to cooperate with said first spring-loaded pin to provide at least one position of disengagement of the pin from said stop hole.

10. An apparatus as claimed in claim 7, wherein said stop means comprises at least one second spring-loaded pin alidable in a seat provided in the support base and having a toothed appendix, this latter being arranged to cooperate with a tooth provided in the box-type body in correspondence with at least said position which determines the defined orientation of the body relative to the base when this latter rests on the floor.

* * * * *